US009926118B2

(12) United States Patent
Guirguis et al.

(10) Patent No.: US 9,926,118 B2
(45) Date of Patent: Mar. 27, 2018

(54) CHILD-RESISTANT CONTAINERS

(71) Applicant: Inline Plastics Corp., Shelton, CT (US)

(72) Inventors: Sameh Guirguis, Monroe, CT (US); Victor Ivenitsky, South Salem, NY (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 15/215,505

(22) Filed: Jul. 20, 2016

(65) Prior Publication Data

US 2017/0158397 A1 Jun. 8, 2017

Related U.S. Application Data

(63) Continuation-in-part of application No. 14/962,927, filed on Dec. 8, 2015.

(51) Int. Cl.
*B65D 43/00* (2006.01)
*B65D 43/16* (2006.01)
(Continued)

(52) U.S. Cl.
CPC ..... *B65D 55/024* (2013.01); *B65D 43/021* (2013.01); *B65D 43/16* (2013.01);
(Continued)

(58) Field of Classification Search
CPC .. B65D 2543/00657; B65D 2543/0062; B65D 2543/00092; B65D 2543/00203; B65D 2543/00296; B65D 2543/00842; B65D 2543/00509; B65D 2543/00546; B65D 2543/00731; B65D 2101/0015; B65D 2101/0023; B65D 2101/003; B65D 2101/0092; B65D 2101/0235; B65D 2101/0266; B65D 5/54; B65D 43/162; B65D 2251/1033; B65D 2251/0023; B65D 17/24; B65D 77/2016; B65D 75/22;
(Continued)

(56) References Cited

U.S. PATENT DOCUMENTS 646,563 A 4/1900 Bontrager et al.
2,438,499 A * 3/1948 Hartman ..... F16B 21/086 411/500
(Continued)

OTHER PUBLICATIONS

U.S. Appl. No. 14/869,868, filed Sep. 29, 2015.
(Continued)

*Primary Examiner* — J. Gregory Pickett
*Assistant Examiner* — Gideon Weinerth
(74) *Attorney, Agent, or Firm* — Locke Lord LLP; David J. Silvia; Alicia J. Carroll

(57) ABSTRACT

The present disclosure is directed to a child-resistant container which includes a lid having a peripheral flange which defines a lifting tab having top and bottom surfaces. The lid includes a protrusion extending downwardly from the bottom surface of the lifting tab. The container includes a base having an upper peripheral rim and a surface formed in a corner portion of the base between two adjacent sides of the base. The surface includes an aperture to receive the downwardly extending protrusion of the lid when the container is closed forming a child-resistant opening mechanism. The surface is uninterrupted but for the aperture.

20 Claims, 12 Drawing Sheets

(51) Int. Cl.
*B65D 55/02* (2006.01)
*B65D 50/00* (2006.01)
*B65D 43/02* (2006.01)

(52) U.S. Cl.
CPC ..... *B65D 50/00* (2013.01); *B65D 43/0235* (2013.01); *B65D 43/162* (2013.01); *B65D 2101/0023* (2013.01); *B65D 2101/0092* (2013.01); *B65D 2215/02* (2013.01); *B65D 2251/1033* (2013.01); *B65D 2251/1066* (2013.01); *B65D 2543/00212* (2013.01); *B65D 2543/00296* (2013.01); *B65D 2543/00509* (2013.01); *B65D 2543/00546* (2013.01); *B65D 2543/00833* (2013.01); *B65D 2543/00842* (2013.01)

(58) Field of Classification Search
CPC .... B65D 81/263; B65D 85/50; B65D 43/169; B65D 43/16; B65D 2251/1066; Y10T 24/45995; Y10T 24/45775
USPC ..... 220/805, 266, 4.21, 270, 839, 324, 835, 220/326, 836, 315, 260, 810
See application file for complete search history.

(56) References Cited

U.S. PATENT DOCUMENTS 2,537,786 A * 1/1951 Poupitch ..... F16J 13/14 220/315
2,873,057 A * 2/1959 Friday ..... B65D 85/324 206/521.1
3,034,693 A * 5/1962 Cox ..... B65D 85/324 206/521.8
3,164,478 A 1/1965 Bostrom
3,217,963 A * 11/1965 Alsman ..... B65D 85/324 206/521.1
3,511,433 A 5/1970 Andrews
3,669,606 A 6/1972 Brown
3,674,295 A * 7/1972 Padovani ..... B65D 85/324 220/787
3,756,115 A * 9/1973 Schuplin ..... F16B 21/086 411/508
3,786,982 A * 1/1974 Rakes ..... B65D 1/26 220/324
3,908,235 A * 9/1975 Telliard ..... B25B 31/005 174/66
4,520,943 A * 6/1985 Nielsen ..... B65D 21/0233 220/281
4,555,043 A 11/1985 Bernhardt
4,576,330 A 3/1986 Schepp
4,742,935 A 5/1988 Schellenberg
4,771,934 A 9/1988 Kalmanides
4,886,204 A 12/1989 Kalmanides
5,046,659 A * 9/1991 Warburton ..... B65D 43/162 220/4.21
5,076,460 A * 12/1991 Hussell ..... B65D 43/164 16/257
5,169,014 A * 12/1992 Hexamer ..... B65D 43/162 220/4.22
5,353,946 A * 10/1994 Behrend ..... B65D 43/169 220/326
5,507,406 A * 4/1996 Urciuoli ..... B65D 43/021 215/209
5,584,408 A * 12/1996 Orkisz ..... B65D 43/162 220/4.22
5,685,444 A 11/1997 Valley
6,305,546 B1 * 10/2001 Saunders ..... B65D 1/36 206/459.1
6,625,955 B2 9/2003 Aylward
7,073,680 B2 7/2006 Boback et al.
7,118,003 B2 10/2006 Sellari et al.
D602,774 S * 10/2009 Parikh ..... D9/435
8,127,961 B2 * 3/2012 Vovan ..... B65D 43/0206 220/212
8,146,766 B2 * 4/2012 Vovan ..... B65D 43/021 220/212
8,167,166 B2 * 5/2012 Kidd ..... B65D 43/162 220/326
8,240,505 B1 8/2012 Chen
8,261,933 B2 9/2012 Kidd et al.
8,272,526 B1 * 9/2012 Vovan ..... B65D 43/0254 215/253
8,608,008 B2 * 12/2013 Gingras ..... B65D 43/0254 220/266
8,640,914 B2 2/2014 Meyer et al.
8,684,212 B2 4/2014 Stone et al.
8,795,580 B2 8/2014 Sellari et al.
8,807,359 B2 * 8/2014 Giraud ..... B65D 47/0804 215/216
8,925,755 B2 1/2015 Lesquir et al.
9,038,851 B2 * 5/2015 Picard ..... B65D 43/162 220/254.1
9,120,595 B2 * 9/2015 Chou ..... B65D 17/24
9,187,209 B1 * 11/2015 Hanna ..... B65D 43/162
9,242,769 B2 1/2016 Gartz et al.
9,278,786 B2 3/2016 Vovan et al.
9,592,937 B1 * 3/2017 Wang ..... B65D 43/0237
2002/0148840 A1 * 10/2002 Torniainen ..... B65D 1/34 220/657
2003/0051350 A1 3/2003 Harrold
2003/0192888 A1 * 10/2003 Chang ..... B65D 43/162 220/4.23
2004/0007583 A1 * 1/2004 Lin ..... B65D 43/162 220/835
2005/0247709 A1 * 11/2005 Atkins ..... B65D 1/36 220/4.23
2006/0289541 A1 12/2006 Boback et al.
2007/0045317 A1 3/2007 Rosender et al.
2007/0138180 A1 * 6/2007 Vovan ..... B65D 43/021 220/266
2009/0120937 A1 5/2009 Vovan
2009/0134179 A1 * 5/2009 Kidd ..... B65D 43/162 220/834
2009/0134180 A1 5/2009 Kidd et al.
2009/0206082 A1 8/2009 Vovan
2009/0223966 A1 * 9/2009 Kidd ..... B65D 75/22 220/324
2010/0072217 A1 3/2010 Parikh et al.
2010/0276422 A1 11/2010 Vovan et al.
2011/0000929 A1 1/2011 Brown et al.
2012/0005944 A1 1/2012 Carswell et al.
2012/0103990 A1 5/2012 McCumber
2013/0020325 A1 1/2013 Stone et al.
2013/0082056 A1 * 4/2013 Oertli ..... A61B 10/0096 220/257.1
2013/0160406 A1 6/2013 Johnston
2013/0320015 A1 12/2013 Dyble et al.
2014/0041343 A1 2/2014 Corbett et al.
2014/0069922 A1 3/2014 Boback et al.
2014/0138383 A1 5/2014 Lisowy et al.
2014/0284346 A1 * 9/2014 McCumber ..... B65D 43/162 220/792
2014/0300034 A1 10/2014 Sellari et al.
2014/0319137 A1 * 10/2014 Hsieh ..... B65D 43/0266 220/253
2014/0367383 A1 12/2014 Sellari et al.
2015/0028033 A1 * 1/2015 Samuel ..... B65D 43/0266 220/270
2015/0060454 A1 * 3/2015 Kowal ..... B65D 43/169 220/269
2015/0060455 A1 3/2015 Chou
2015/0083725 A1 3/2015 Sinha et al.
2015/0225139 A1 8/2015 Baker
2015/0266611 A1 9/2015 Dow et al.
2015/0298853 A1 10/2015 Chen
2015/0307239 A1 * 10/2015 Chen ..... B65D 43/162 220/270
2015/0321799 A1 * 11/2015 Lam ..... B65D 43/22 220/315

(56) References Cited

U.S. PATENT DOCUMENTS

| | | | | |
|---|---|---|---|---|
| 2015/0329249 | A1 | 11/2015 | Gingras et al. | |
| 2015/0367987 | A1 | 12/2015 | Clark et al. | |
| 2016/0016707 | A1 | 1/2016 | Sellari et al. | |
| 2016/0023815 | A1 * | 1/2016 | Siskindovich ..... | B65D 43/0254 220/270 |

OTHER PUBLICATIONS

PCT International Search Report and Written Opinion dated Mar. 14, 2017, issued during the prosecution of PCT International Patent Application No. PCT/US2016/064283 (12 pages).
PCT International Search Report and Written Opinion dated Mar. 17, 2017, issued during the prosecution of PCT International Patent Application No. PCT/US2016/064281 (17 pages).
Non-Final Office Action dated Dec. 30, 2016 issued in U.S. Appl. No. 15/215,496.

* cited by examiner

Fig. 9
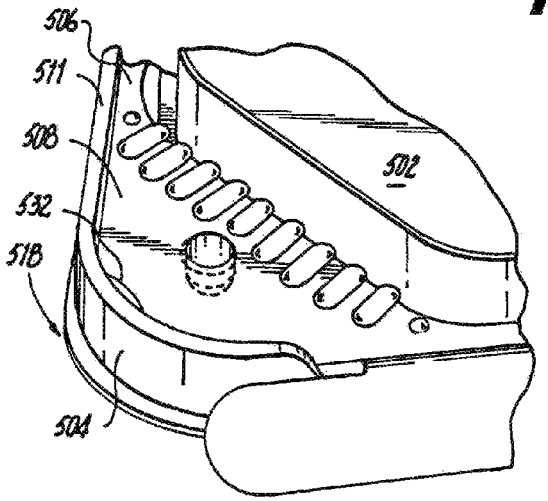
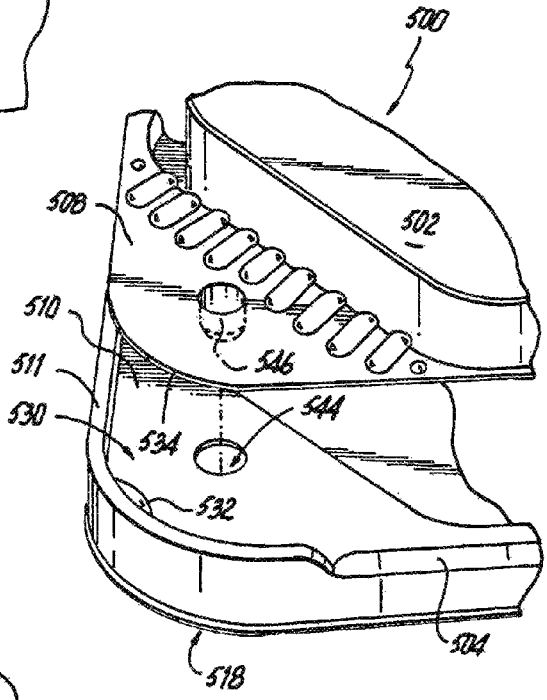
Fig. 10
Fig. 11
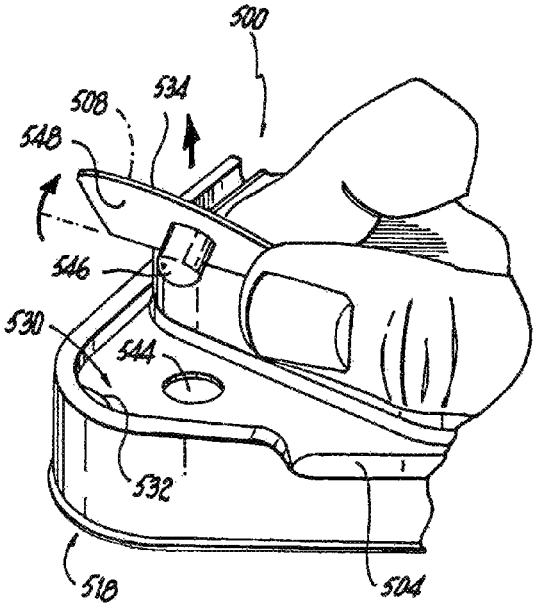

Fig. 13
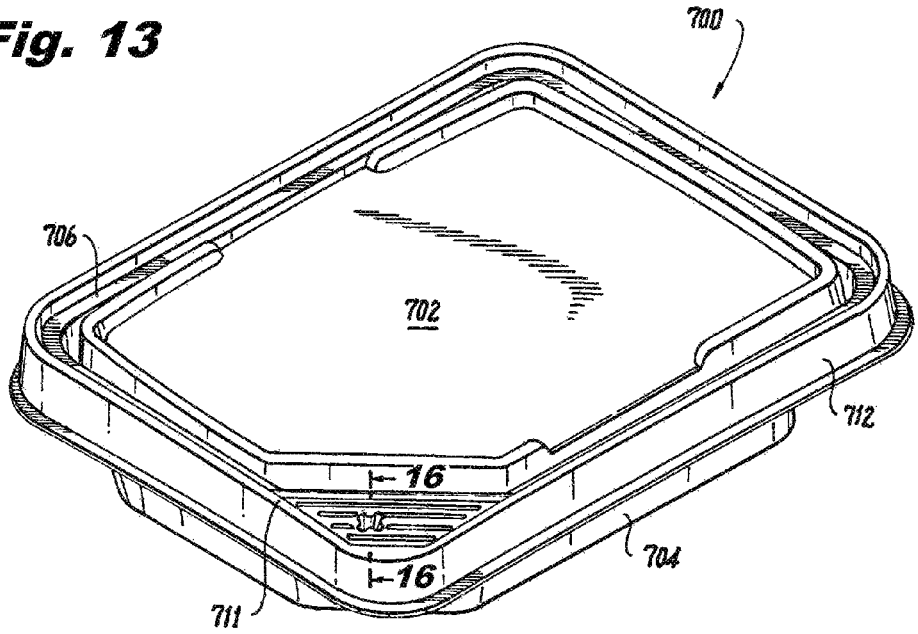
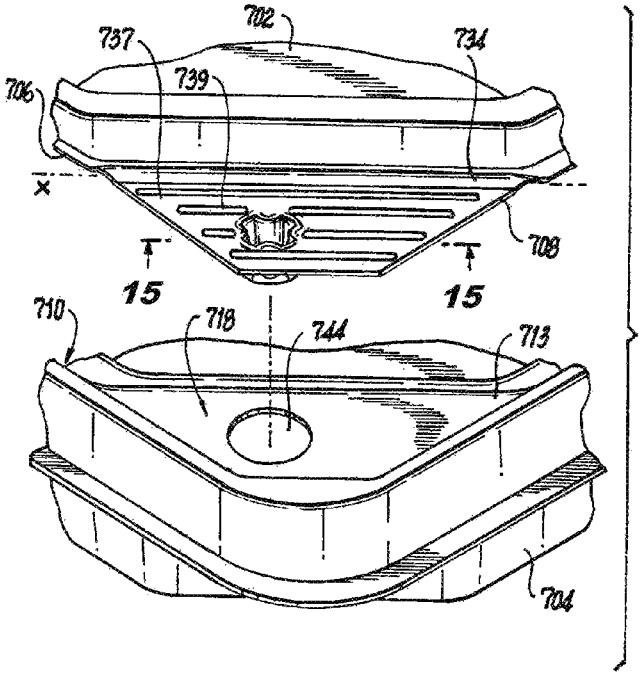
Fig. 14
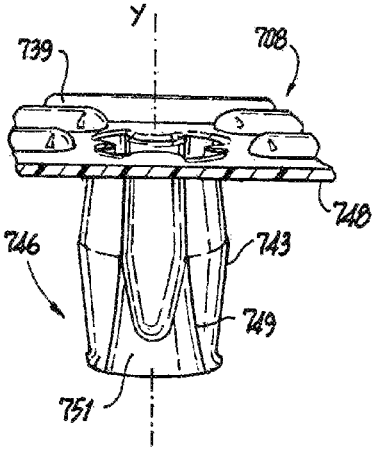
Fig. 15

CHILD-RESISTANT CONTAINERS

CROSS-REFERENCE TO RELATED APPLICATIONS

This application is a continuation-in-part of U.S. patent application Ser. No. 14/962,927 filed Dec. 8, 2015, which is incorporated by reference herein in its entirety.

BACKGROUND OF THE INVENTION

1. Field of the Invention

The subject invention is directed to containers and packaging, and more particularly, to containers and packaging that incorporate child-resistant features.

2. Background of the Related Art

Disposable containers for packaging, distributing, displaying or otherwise housing consumer items, some of which are not safe for use by children, are becoming increasingly important. The advent of plastics resulted in many products being wrapped or packaged in plastic, both in the form of flexible plastic bags and rigid plastic containers. The use of plastics in the modern-day convenience food industry has significantly improved the "shelf life" of perishable products, allowing both merchants and their customers to store the products for longer periods of time, resulting in substantial savings.

It has been found that consumers like reclosable packages, particularly for comestible products, especially in circumstances where more than one serving of a comestible product is contained therein, in order to reduce drying out or other deterioration of the comestible food product. In addition, consumers prefer to visually inspect the product within such containers prior to purchase. Thus, fabricating containers from clear see-through plastics is desirable. In addition to the aforementioned consumer design preferences, it is desirable to fabricate containers that include features which either deter unauthorized tampering or clearly indicate whether unauthorized tampering has occurred, or both.

Thus, there is a need for containers having design elements, such as recloseability features which are reliable and easy to operate, along with child-resistant features that deter children from gaining access to the contents of the container. Accordingly, the present invention is directed to a container that meets these needs.

SUMMARY OF THE DISCLOSURE

The present disclosure is directed to a child-resistant container which includes a lid having a peripheral flange which defines a lifting tab having top and bottom surfaces. The lid includes a protrusion extending downwardly from the bottom surface of the lifting tab. The container includes a base having an upper peripheral rim and a surface formed in a corner portion of the base between two adjacent sides of the base. The surface includes an aperture to receive the downwardly extending protrusion of the lid when the container is closed forming a child-resistant opening mechanism. The surface is uninterrupted but for the aperture.

In accordance with some embodiments, the protrusion defines a longitudinal axis and includes a plurality of pairs of tapered surfaces. Each pair of tapered surfaces includes a first tapered surface diverging radially outward from the longitudinal axis toward a second beveled surface. The second tapered surface converges radially inward from the first tapered surface toward the longitudinal axis. The pairs of tapered surfaces are circumferentially spaced apart from adjacent pairs of tapered surfaces by longitudinally extending indented surfaces in the protrusion. The longitudinally indented surfaces are indented radially inward toward the longitudinal axis with respect to the pairs of tapered surfaces. Each pair of tapered surfaces defines an apex between the first and second beveled surfaces.

In accordance with some embodiments, the lifting tab includes a hinge extending between adjacent sides of the lid. The hinge is raised with respect to the top surface of the lifting tab. The lifting tab includes ribs extending upwardly from the top surface of the lifting tab. A tamper-evident hinge joining the lid with the base, the tamper-evident hinge including a frangible section. The frangible section can include at least one line of weakness. The frangible section can include a single score line and/or two parallel score lines defining a tear strip therebetween. The surface formed in a corner portion of the base and the tamper-evident hinge can be on the same lateral side of the base. The upper peripheral rim includes a bead extending upwardly from the upper peripheral rim which extends substantially about the perimeter of the container. A skirt can extend downwardly from the bead.

These and other unique features of embodiments of the present invention will become more readily apparent from the following description and the accompanying drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 9 is a perspective view of a portion of another embodiment of a child-resistant, tamper-resistant and tamper-evident container constructed in accordance with the present invention, showing a lifting tab within a recess of the corner portion of the base in the closed position;

FIG. 10 is a perspective exploded view of a portion of the container shown in FIG. 9, showing a protrusion extending from a bottom surface of a lifting tab;

FIG. 11 is a perspective view of a portion of the container shown in FIG. 9, showing the container being opened with lifting tab raised from the recess of the corner portion;

FIG. 13 is a perspective view of another embodiment of a child-resistant, tamper-resistant container constructed in accordance with the present invention, showing a two piece container without a hinge;

FIG. 14 is a perspective exploded view of a portion of the container shown in FIG. 13, showing a protrusion extending from a bottom surface of a lifting tab;

FIG. 15 is a perspective view of a portion of the container shown in FIG. 13, showing the protrusion including a plurality of pairs of tapered surfaces and a longitudinally indented surface;

DETAILED DESCRIPTION OF THE PREFERRED EMBODIMENTS

Figure 1:
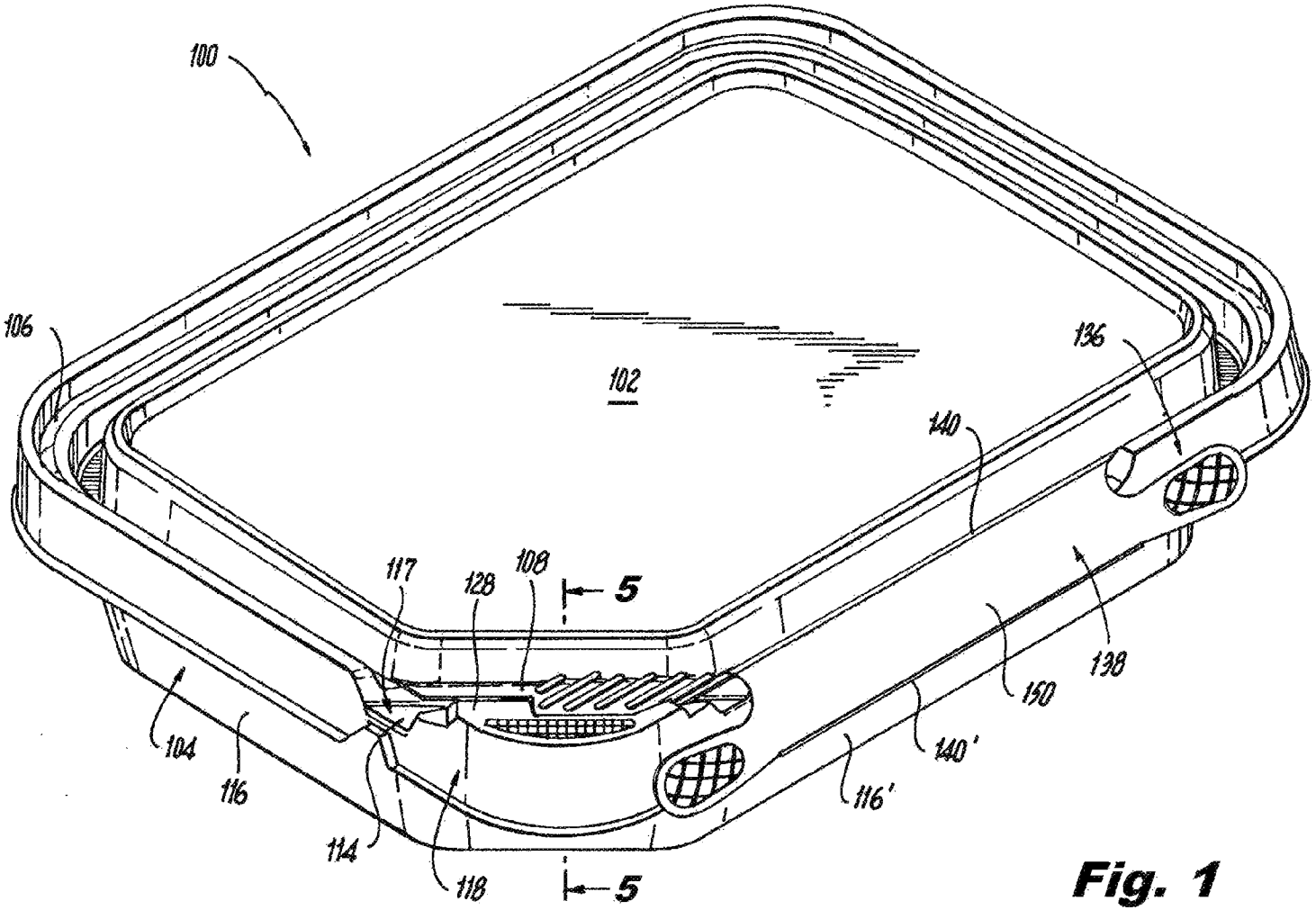
FIG. 1 is a perspective view of a child-resistant, tamper-resistant and tamper-evident container constructed in accordance with the present invention having a lid and a base, and showing a corner portion of the base accommodating a lifting tab of the lid when the container is closed forming a child-resistant opening mechanism.

Reference will now be made to the drawings wherein like reference numerals identify similar structural features or aspects of the subject disclosure. For purposes of explanation and illustration, and not limitation, a partial view of an exemplary embodiment of a child-resistant container 100 in accordance with the disclosure is shown in FIG. 1 and is designated generally by reference character 100. Other embodiments of child-resistant containers in accordance with the disclosure, or aspects thereof, are provided in FIGS. 2-10, as will be described.

As shown in FIG. 1, a reclosable child-resistant container 100 includes a lid 102 and a base 104. Lid 102 includes a peripheral flange 106 that defines a lifting tab 108. It is contemplated that peripheral flange 106 can be outwardly extending and/or upwardly extending from lid 102. In the embodiment shown flange 106 extends upwardly and outwardly from lid 102. A bend line 117 extends between two adjacent sides 116 and 116' of base 104 to define a corner portion 118 of base 104. Bend line 117 facilitates the bending of corner portion 118 of base 104 to gain access to lifting tab 108. Bend line 117 is defined by a groove 114 extending between sides 116 and 116'. In addition to or instead of groove 114, it is contemplated that bend line 117 can be defined by a line or section of material thinner than the material on other portions of container 100, material cuts or perforations, or any other suitable weakening feature that facilitates bending between corner portion 118 and the remainder of base 104. In the closed position, lifting tab 108 is nested within corner portion 118 of base 104.

With continued reference to FIG. 1, base 104 includes a plateau 128 on corner portion 118 of base 104. In the closed position, lifting tab 108 is rendered relatively inaccessible by plateau 128, forming a child-resistant opening mechanism. Those skilled in the art will readily appreciate that child-resistance can be gauged by testing container 100 in accordance with International Organization for Standardization (ISO) Standard ISO 8317:2013(E).

Figure 2:
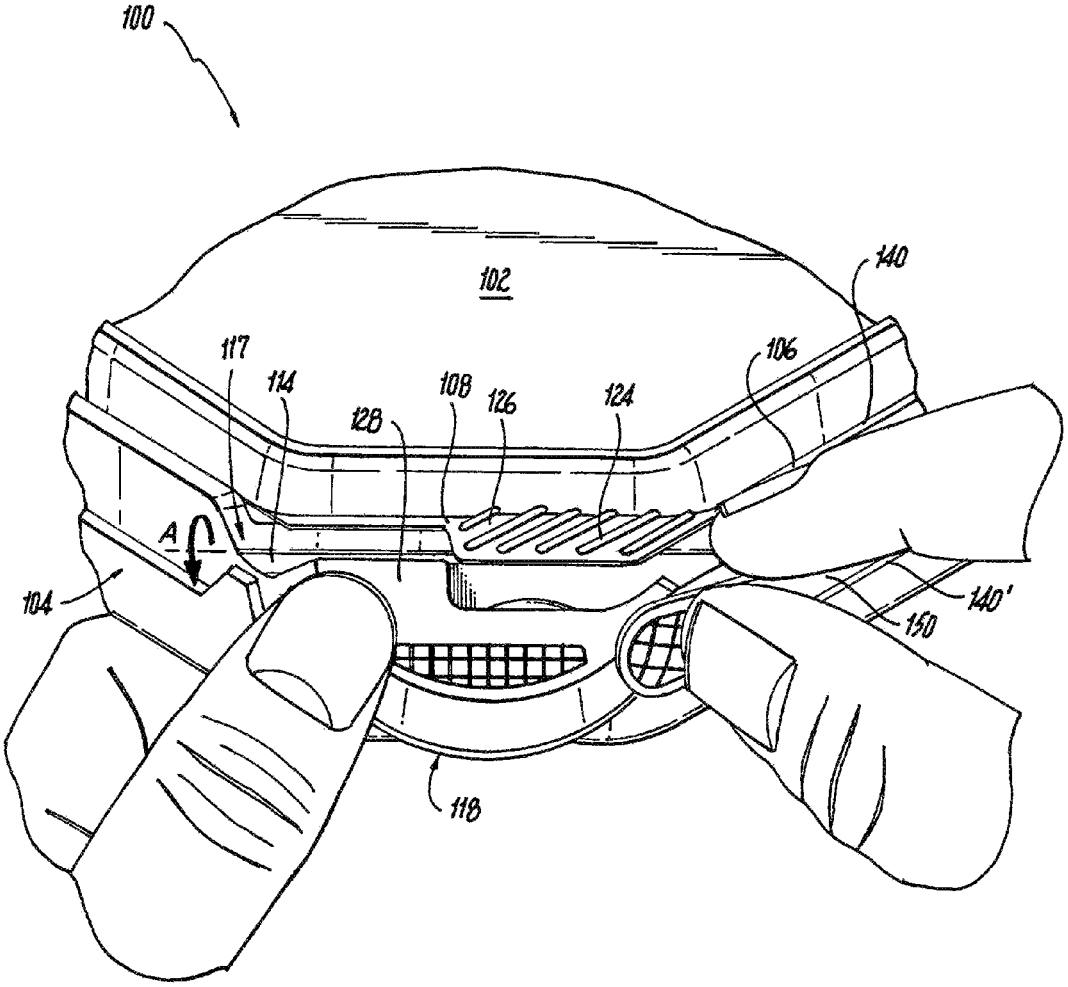
FIG. 2 is a perspective view of a portion of the container of FIG. 1, showing the corner portion of the base being bent downward to gain access to the lifting tab of the lid.

With reference now to FIG. 2, container 100 is accessed by bending corner portion 118 downward, as oriented in FIG. 2, about bend line 117, e.g. away from lifting tab 108. In accordance with this embodiment, bend line 117 is substantially aligned with a longitudinal axis A defined by groove 114. By bending corner portion 118 downward, plateau 128 is moved lower than lifting tab 108 and access to lifting tab 108 is provided. Lifting tab 108 includes ribs 124 extending upwardly from a top surface 126 of lifting tab 108 to assist in gripping lifting tab 108. A consumer can then raise lifting tab 108, thereby applying force to remove lid 102 from base 104 and open container 100. Bend line 117 is resilient so that, if needed, corner portion 118 can be bent about bend line 117 multiple times.

Figure 3:
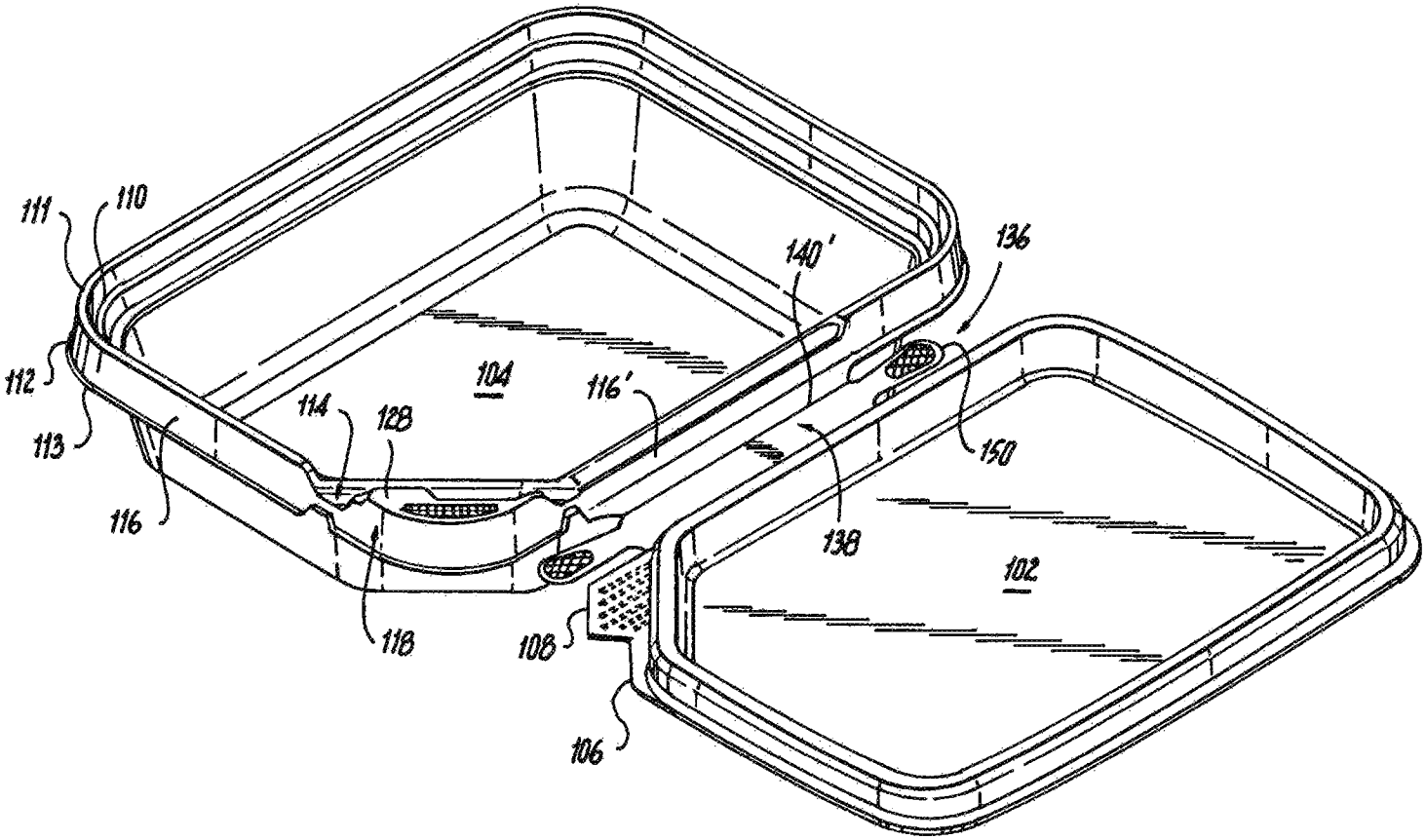
FIG. 3 is a perspective view of the container of in FIG. 1, showing the container in an open position.

As shown in FIGS. 1 and 3, container 100 includes a tamper-evident hinge 136 joining lid 102 with base 104. Hinge 136 includes a frangible section 138. Frangible section 138, in the embodiment shown, includes two lines of weakness 140 and 140', e.g. parallel score lines, perforation lines, and/or other suitable weakened or stressed lines, which define a tear strip 150. Those skilled in the art will readily appreciate that while container 100 is shown with two lines of weakness 140 and 140', any suitable number of lines of weakness can be used. For example, one line of weakness can be used. In the case where one line of weakness is used, the frangible section can be severed by depressing the one line of weakness. In the embodiment shown, corner portion 118 of base 104 and tamper-evident hinge 136 are on the same lateral side of base 104 so that before, or concurrently with, accessing lifting tab 108 and opening container 100, frangible section 138 is severed, effectively signaling that container 100 has been tampered with.

With continued reference to FIGS. 1 and 3, if tear strip 150 is removed prior to bending corner portion 118 downward and gaining access to lifting tab 108, or if container 100 has been reclosed after already being opened, it is contemplated that the child-resistance of container 100 is still intact. Peripheral flange 106 that remains after removing tear strip 150 is small, e.g. a micro-flange, and is in overlapping abutment with an upper peripheral rim 110 of base 104, described in more detail below, such that access to container 100 through peripheral flange 106 is resisted. This means that to gain access to container 100, a consumer will still have to bend corner portion 118 downwardly to gain access to lifting tab 108, and then raise lifting tab 108 to remove the lid 102 from the base 104.

As shown in FIG. 3, container 100 is in the open position prior to being filled and closed for sale to consumers. Base 104 includes an upper peripheral rim 110. In this embodiment, upper peripheral rim 110 is extended upwardly to include an upwardly extending bead 111. Bead 111 extends substantially about the perimeter of container 100. Those skilled in the art will readily appreciate that, in the embodiment shown, a skirt 112 extends downwardly from bead 111 to a lower edge 113 thereof. It is contemplated that in embodiments without bead 111 on upper peripheral rim 110, skirt 112 depends downwardly directly from upper peripheral rim 110. In the closed position, peripheral flange 106 is in overlapping abutment with upper peripheral rim 110 and laterally abuts bead 111, rendering flange 106 relatively inaccessible, compelling the consumer to access container 100 at corner portion 118.

Figure 12:
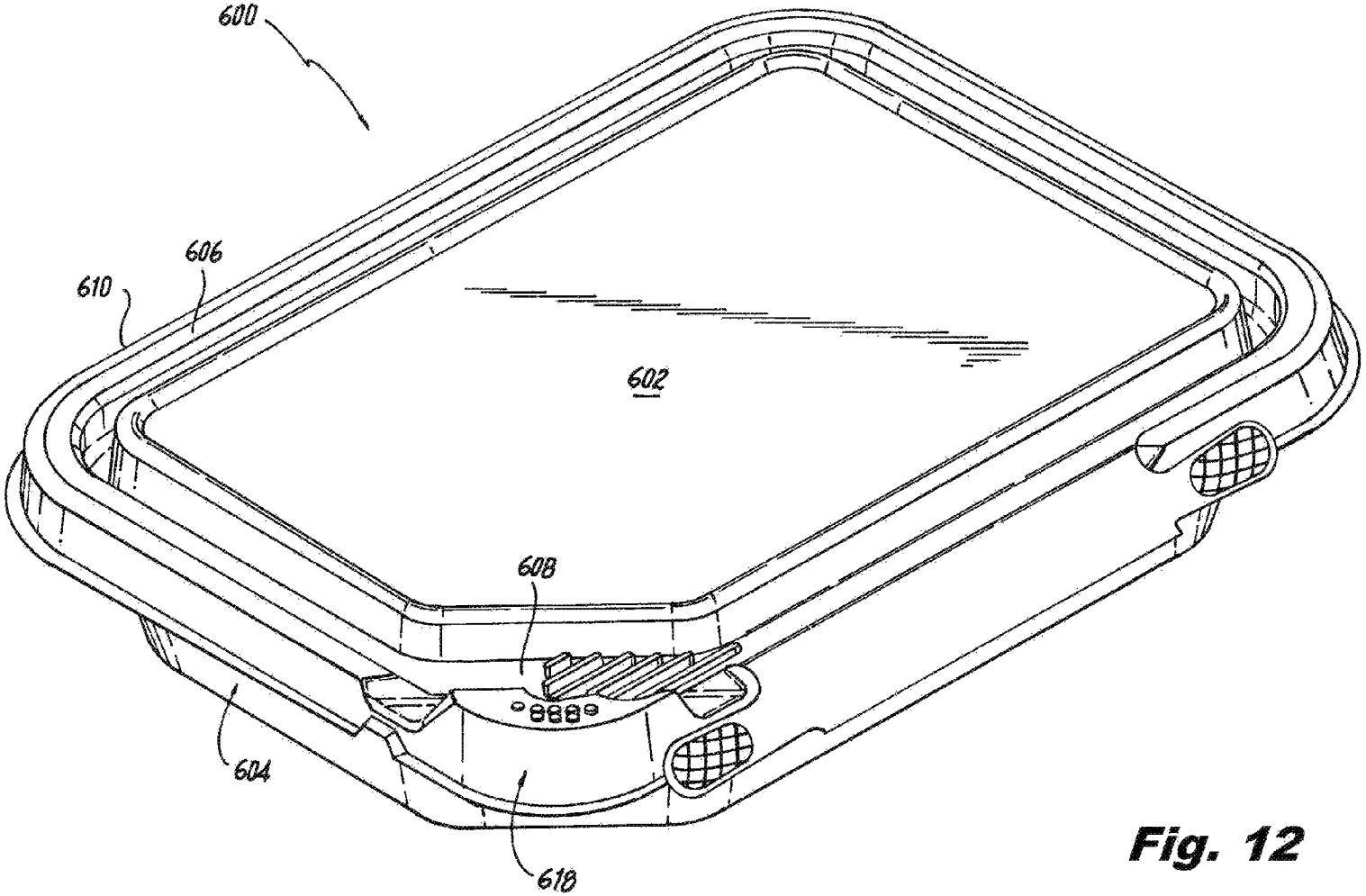
FIG. 12 is a perspective view of another embodiment of a child-resistant, tamper-resistant and tamper-evident container constructed in accordance with the present invention, showing overlapping abutment between the upper peripheral rim of the base and the peripheral flange of the cover.

With reference now to FIG. 12, another embodiment of a child-resistant container 600 is shown. Container 600 includes a lid 602 and a base 604. Container 600 is similar to container 100 in that lid 602 includes a peripheral flange 606 that defines a lifting tab 608. Container 600, however, does not include a bead, e.g. bead 111. The overlapping abutment between peripheral flange 606 and upper peripheral rim 610, is sufficient to hinder access to the peripheral flange 606. It is contemplated that peripheral flange 606 is small enough that, even if physical access to peripheral flange 606 is not blocked or rendered inaccessible by a bead, e.g. bead 111, the overlapping abutment between peripheral flange 606 as it extends outwardly from lid 602 and upper peripheral rim 610 is sufficient to hinder access to flange 606.

Alternatively, even without an overlapping abutment between flange 106 and upper peripheral rim 110, the lateral abutment between flange 106 and upper peripheral rim 110, as flange 106 extends upwardly from lid 102 is sufficient to hinder access to flange 106. Moreover, even if a consumer can lift flange 106, the lifting force required to remove lid 102 from base 104 cannot easily be transmitted through flange 106 because of its small size.

Figure 4:
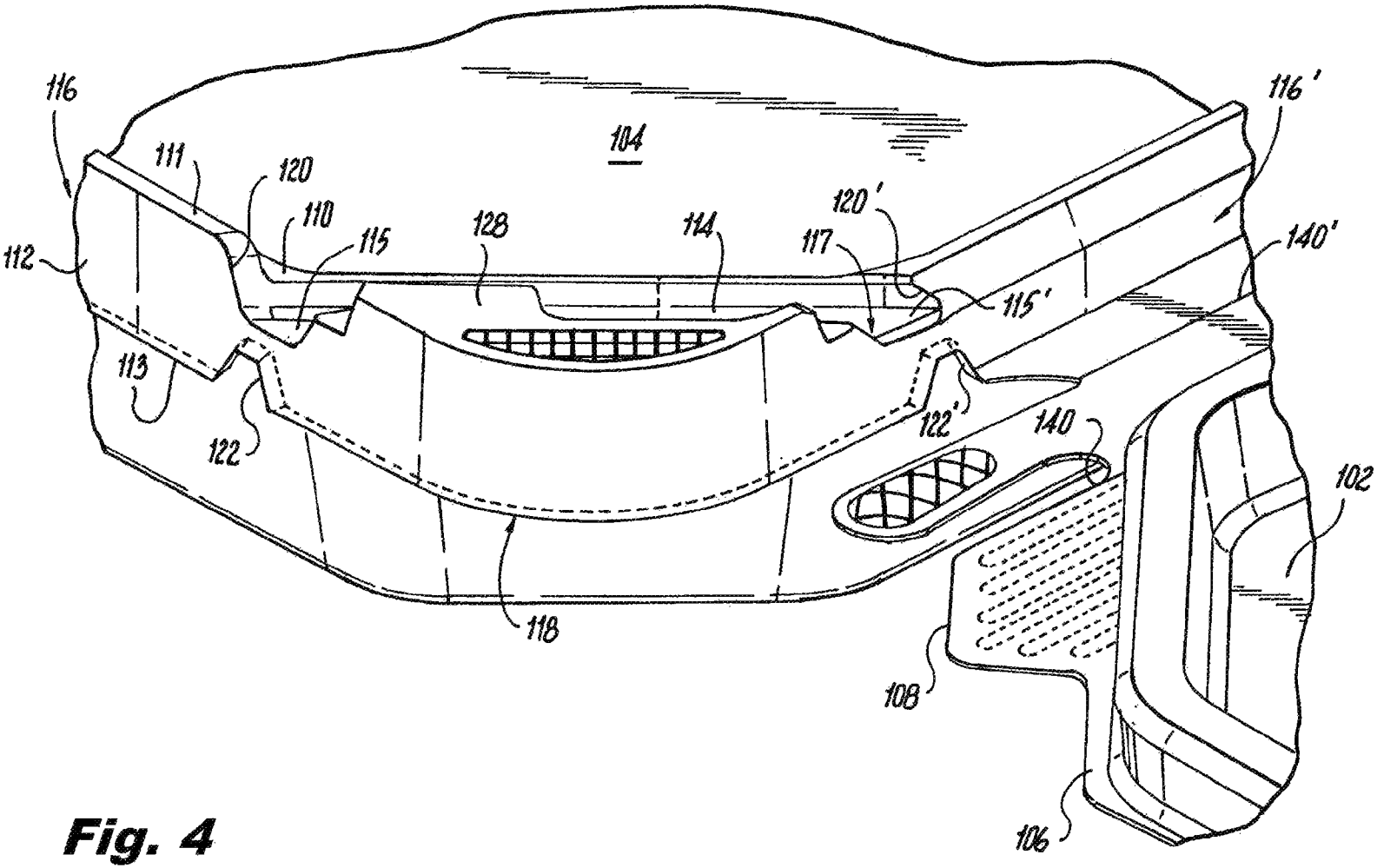
FIG. 4 is a perspective view of a portion of the container of FIG. 1, showing the container in an open position and the corner portion of the base having opposed indented portions and relief sections.

With reference now to FIG. 4, base 104 includes opposed indented portions 120 and 120' in skirt 112. A pair of relief sections 122 and 122', e.g. a pair of notches, is defined in lower edge 113 of the skirt 112. Each notch 122 and 122' is adjacent to a respective one of opposed indented portions 120 and 120'. Each notch 122 and 122' corresponds to a respective end 115 and 115' of bend line 117. Each notch 122 and 122' is defined on a respective side of the two adjacent sides 116 and 116' of base 104. Each notch 122 and 122' extends upwardly toward bend line 117 and groove 114. Each of the opposed indented portions 120 and 120' is adjacent to one of the ends 115 and 115' of bend line 117 and also define the ends of groove 114. Notches 122 and 122' provide clearance and reduced resistance for corner portion 118 during bending, tending to increase the ease of bending corner portion 118. Indented portions 120 and 120' similarly reduce the resistance to the bending of corner portion 118. Additionally, indented portions 120 and 120' and notches 122 and 122' assist in helping corner portion 118 return to its original, un-bent state after bending so that container 100 can readily be reused and remain child-resistant. While container 100 is shown and described herein as having notches 122 and 122', those skilled in the art will readily appreciate that they are not required for corner portion 118 to bend.

Figure 5:
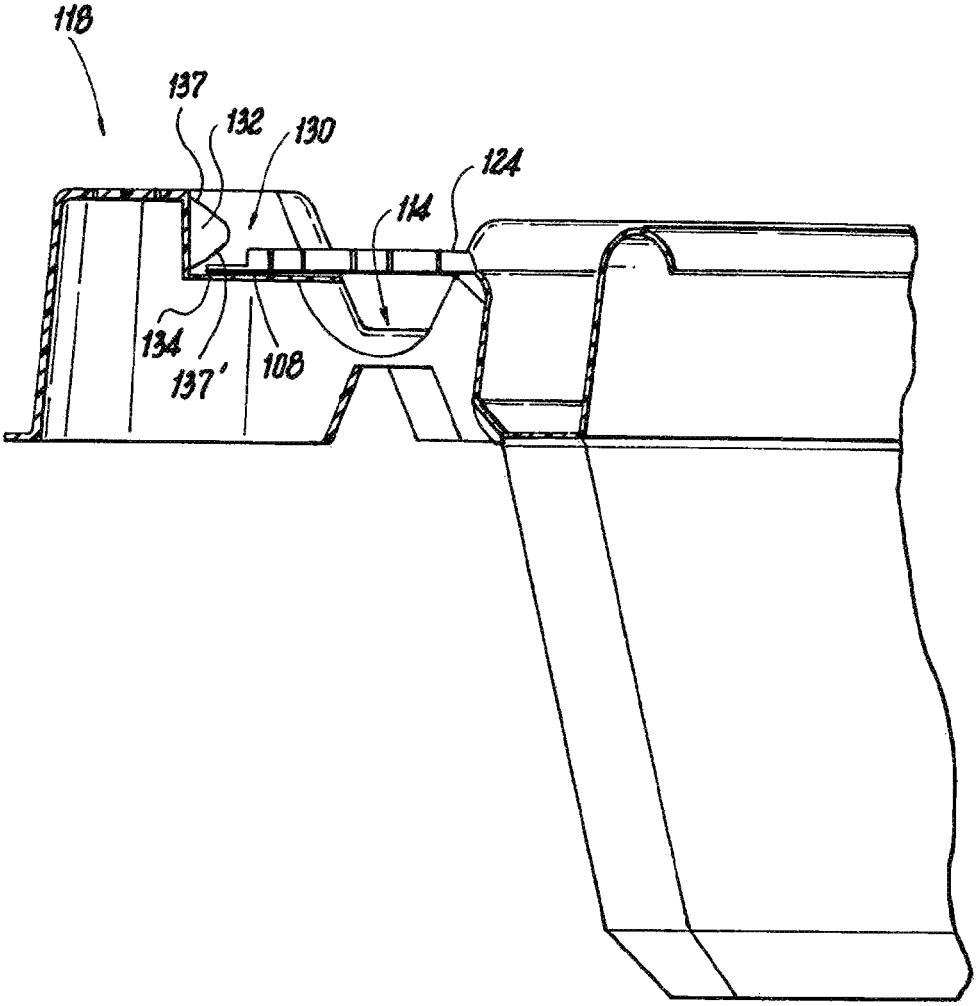
FIG. 5 is a cross sectional view of a portion of the container shown in FIG. 1, taken along line 5-5 of FIG. 1, showing the retaining portion keeping the lifting tab within the recess when the container is closed.

With reference now to FIG. 5, base 104 includes a recess 130 defined in corner portion 118 of base 104 adjacent to plateau 128 to receive lifting tab 108 when container 100 is closed. Base 104 includes a retaining projection 132 extending into recess 130 overlapping an outer edge 134 of lifting tab 108 when container 100 is closed. Retaining projection 132 includes beveled surfaces 137 and 137'. Beveled surface 137 faces in a direction away from the recess 130, e.g. away from lifting tab 108 when container 100 is closed. Beveled surface 137' faces in a direction toward the recess 130, e.g. toward lifting tab 108 when container 100 is closed. Retaining projection 132 keeps lifting tab 108 seated within recess 130 when container 100 is closed. Bending of corner portion 118, described above, acts to release lifting tab 108 from retaining projection 132 so that lifting tab 108 can be accessed.

Figure 6:
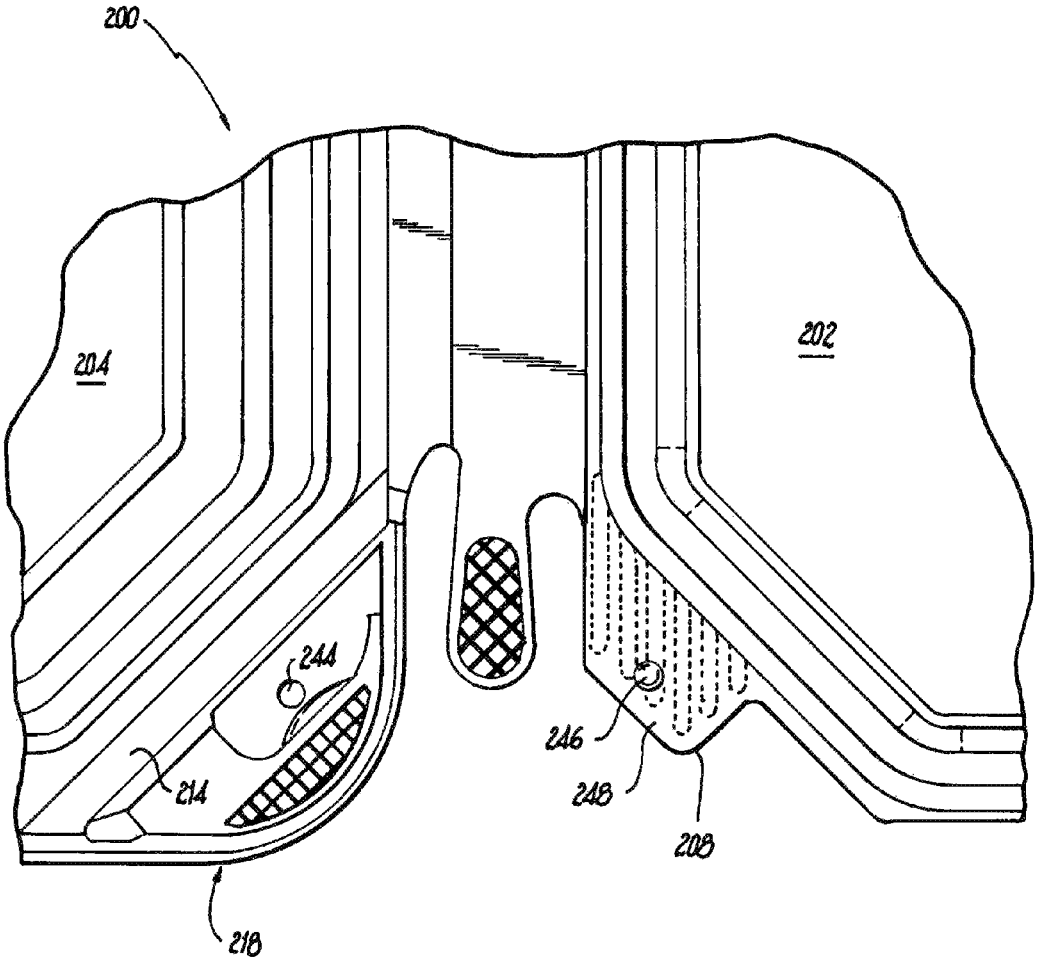
FIG. 6 is a top view of a portion of another embodiment of a child-resistant, tamper-resistant and tamper-evident container constructed in accordance with the present invention, showing the container having a lifting tab with a protrusion extending from a bottom surface thereof.

As shown in FIG. 6, another embodiment of a child-resistant container 200 is shown. Container 200 is similar to container 100. Container 200, however, includes a lid 202 having a lifting tab 208 with a top surface, not shown, and a bottom surface 248. Lifting tab 208 has a protrusion 246 extending from bottom surface 248. When container 200 is closed, protrusion 246 extends into an aperture 244 formed in corner portion 218 of the base 204. Protrusion 246 extends through aperture 244 and is accessible from the lower surface of corner portion 218 to provide additional lifting assistance for lifting tab 208. For example, instead of, or in addition to, bending corner portion 218 downward, a consumer can press protrusion 246 upward from the lower surface of corner portion 218 through aperture 244, thereby raising lifting tab 208.

Figure 7:
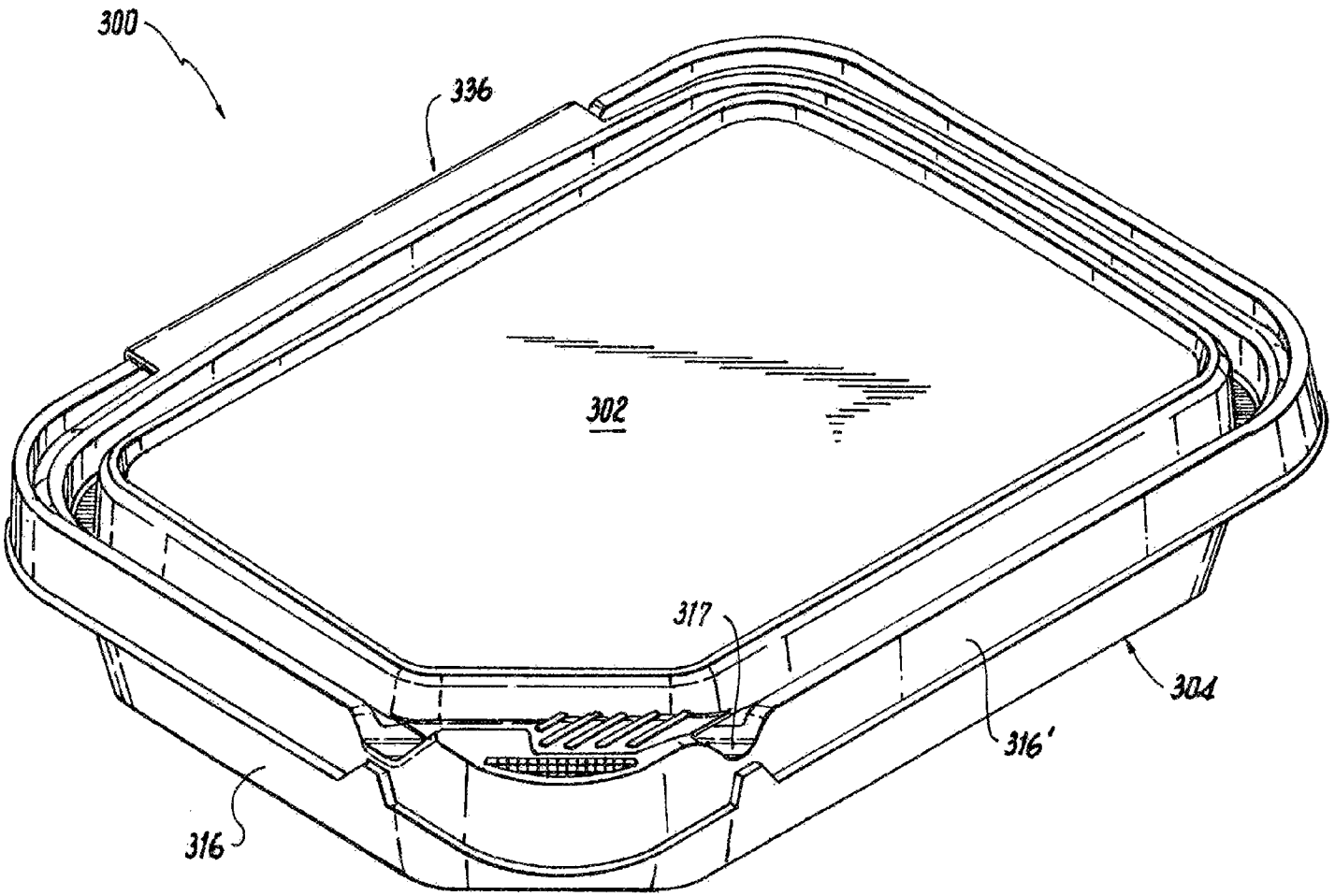
FIG. 7 is a perspective view of another embodiment of a child-resistant, tamper-resistant container constructed in accordance with the present invention, showing the container having a corner portion on the opposite lateral side from the hinge.

As shown in FIG. 7, another embodiment of a child-resistant container 300 is shown. Container 300 is similar to container 100. Container 300, however, includes a base 304 having a bend line 317 extending between two adjacent sides 316 and 316' and of base 304 to define a corner portion 318 that is opposite from hinge 336.

Figure 8:
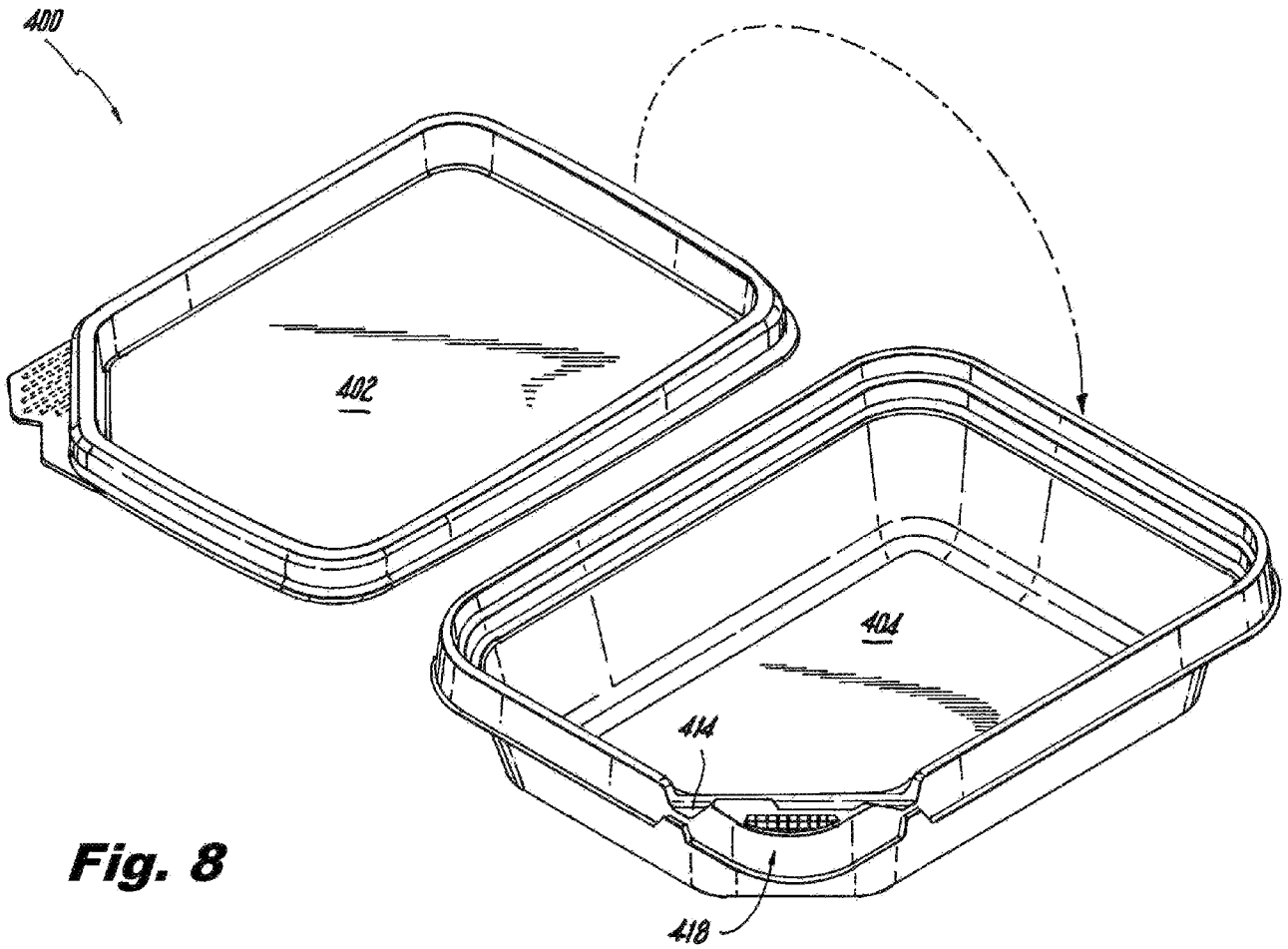
FIG. 8 is a perspective view of another embodiment of a child-resistant, tamper-resistant container constructed in accordance with the present invention, showing a two piece container without a hinge.

With reference now to FIG. 8, another embodiment of a child-resistant container 400 is shown. Container 400 is similar to container 100. Container 400, however, is a two piece container without a hinge, e.g. hinge 136 or 336.

As shown in FIGS. 9 and 10, another embodiment of a child-resistant container 500 is shown. Container 500 includes a lid 502 and a base 504. Container 500 is similar to container 200 in that lid 502 includes a peripheral flange 506 that defines a lifting tab 508. Base 504 includes an upper peripheral rim 510 and a bead 511 upwardly extending from upper peripheral rim 510. Peripheral flange 506 and lifting tab 508 are both rendered relatively inaccessible by bead 511. Those skilled in the art will readily appreciate that bead 511 is not necessary around the entirety of the perimeter and that the overlapping abutment between peripheral flange 506 and upper peripheral rim 510, as described above, is sufficient to hinder access to the peripheral flange 506 and to provide sufficient resistance to compel a consumer to use lifting tab 508 and a corner portion 518 to open container 500.

With reference now to FIGS. 10 and 11, base 504 includes a recess 530 defined in corner portion 518 of base 104. Base 504 includes a retaining projection 532 extending into recess 530 overlapping an outer edge 534 of lifting tab 508 when container 500 is closed, as shown in FIG. 9. Retaining projection 532 is similar to retaining projection 132, described above, and keeps lifting tab 508 seated within recess 530 when container 500 is closed. It is contemplated that container 500 can include a hinge, e.g. hinges 136 or 336.

With reference now to FIG. 11, lifting tab 508 is shown in a lifted position. Lifting tab includes a protrusion 546 extending from a bottom surface 548 thereof. Protrusion 546 extends into an aperture 544 formed in corner portion 518 of the base 504 when the container 500 is closed, as shown in FIG. 9. Protrusion 546 is accessible from the lower surface of corner portion 518 to provide lifting assistance for lifting tab 508, similar to protrusion 246 described above.

As shown in FIGS. 13-15, another embodiment of a child-resistant container 700 is shown. Container 700 includes a lid 702 and a base 704, similar to the previously described embodiments. Container 700 is similar to container 500 in that lid 702 includes a peripheral flange 706 that defines a lifting tab 708. Base 704 includes an upper peripheral rim 710 having a bead 711. A skirt 712 extends downwardly from bead 711 of upper peripheral rim 710. Those skilled in the art will readily appreciate that rim 710 and bead 711 are similar to those described in previous embodiments. Furthermore, is not necessary for rim 710 to be raised with respect to peripheral flange 706 around the entirety of the perimeter of container 700, as overlapping abutment between peripheral flange 706 and upper peripheral rim 710 and bead 711, or lateral abutment, where flange 706 is flush with peripheral rim 710 and bead 711, between peripheral flange 706 and upper peripheral rim 710 and bead 711, as described above, is sufficient to hinder access to peripheral flange 706 and to provide sufficient resistance to compel a consumer to use lifting tab 708 and a corner portion 718 to open container 700.

With reference now to FIGS. 14-15, lifting tab 708 includes top and bottom surfaces 737 and 748, respectively. Lid 702 includes a protrusion 746 extending downwardly from bottom surface 748 of lifting tab 708. Base 704 includes a surface 713 formed in corner portion 718 of base 704 between two adjacent sides of base 704. Surface 713 includes an aperture 744 to receive the downwardly extending protrusion 746 of lid 702 when container 700 is closed forming a child-resistant opening mechanism. Surface 713 is uninterrupted but for aperture 744.

Figure 16:
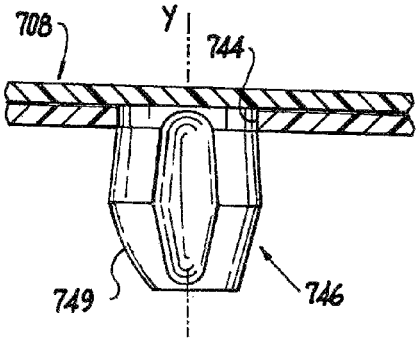
FIG. 16 is a schematic cross sectional view of a portion of the container shown in FIG. 13, showing the lifting tab in a closed position with the protrusion locked within the aperture.
Figure 17:
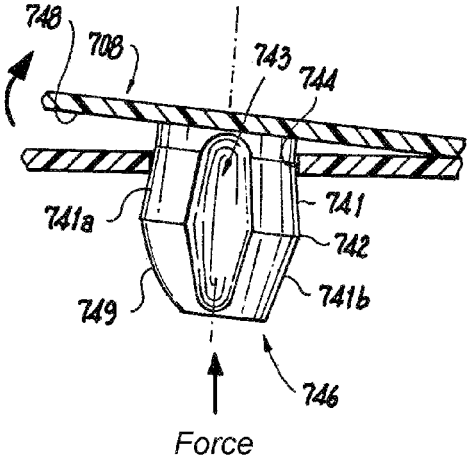
FIG. 17 is a schematic cross sectional view of a portion of the container shown in FIG. 13, showing the lifting tab in a partially raised position during opening.

As shown in FIGS. 15-17, protrusion 746 defines a longitudinal axis Y and includes a plurality of pairs of tapered surfaces 741, e.g. conical surfaces. Each pair of tapered surfaces 741 includes a first tapered surface 741*a* diverging radially outward from longitudinal axis Y toward a second tapered surface 741*b*. Second tapered surface 741*b* converges radially inward from first tapered surface 741*a* toward the longitudinal axis Y. Pairs of tapered surfaces 741 are circumferentially spaced apart from adjacent pairs of tapered surfaces 741 by longitudinally extending indented surfaces 743. Longitudinally extending indented surfaces 743 are indented radially inward toward longitudinal axis Y with respect to pairs of tapered surfaces 741. Each pair of tapered surfaces 741 defines an apex 742 between first and second tapered surfaces 741*a* and 741*b*, respectively. For two of the four pairs of tapered surfaces 741 shown in the figures, tapered surfaces 741*a* and 741*b* are conical. For the other two pairs of tapered surfaces 741, one of which is shown on the left-hand side as oriented in FIGS. 16-18, tapered surfaces 741*b* each include an arcuate beveled edge 749, making tapered surfaces 741*b* not entirely conical. Beveled edges 749 are formed due to beveled surface 751 on protrusion 746, as shown in FIG. 15. Beveled surface 751 is oriented to face away from a hinge axis X, e.g. toward the left-hand side of aperture 744 as oriented in FIGS. 16-18.

With reference now to FIG. 14, lifting tab 708 includes a hinge 734 extending between adjacent sides of lid 702. Hinge 734 is raised with respect to top surface 737 of lifting tab 708. Lifting tab 708 includes ribs 739 extending upwardly from top surface 737 of lifting tab 708 to assist with gripping lifting tab 708. Lifting tab 708 rotates about hinge 734 and hinge axis X when force is applied to protrusion 746.

Figure 18:
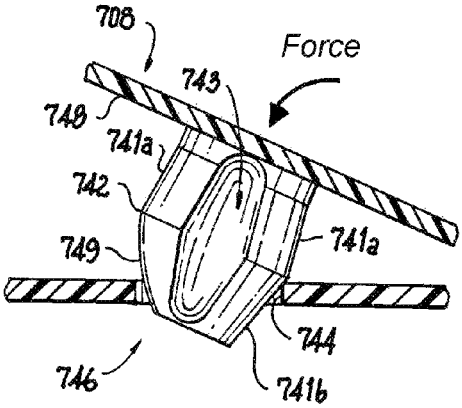
FIG. 18 is a schematic cross sectional view of a portion of the container shown in FIG. 13, showing the lifting tab in a partially raised position during closure.

As shown in FIGS. 16-18, when container 700 is in a closed position, as shown in FIG. 16, to gain access to lifting tab 708 a force can be applied to protrusion 746. Hinge 734 is a stiff hinge such that when container 700 is closed, and protrusion 746 is in aperture 744, lifting tab 708 rests in a downward position, e.g. it abuts surface 713. As shown in FIG. 17, the force applied to protrusion 746 raises protrusion 746 out of aperture 744, rotates lifting tab 708 about hinge axis X, and raises lifting tab 708 so that it can be used to open container 700, similar to lifting tab 508 and container 500, as shown in FIG. 11. The undercut formed with tapered surfaces 741*a* combined with the width of apexes 742 on protrusion 746 tend to require additional force to be applied in order for protrusion 746 to be released from aperture 744, as the width of protrusion 746 in a direction perpendicular to longitudinal axis Y at apex 742 is wider than aperture 744. The undercut and apexes 742 operate to retain lifting tab 708 in the closed position when container 700 is closed so that, in order to gain access to lifting tab 708 and open container 700, force must first be applied to protrusion 746. Once lifting tab 708 is raised, lifting tab 708 is then used to lift and release lid 702 from base 704. Protrusion 746 can return into aperture 744 and lock therein by applying force to lifting tab 708 as shown in FIG. 18. This makes it so that the child-resistant corner portion 718 can be reused multiple times, if desired. Arcuate beveled edge 749 and beveled surface 751 tend to assist in keeping protrusion 746 from resting on the rim of aperture 744 which allows protrusion 746 to enter into aperture 744 more easily.

It is contemplated that, in accordance with some embodiments, a tamper-evident hinge, e.g. a tamper-evident hinge 136, as shown in FIG. 1, can join the lid 702 with base 704. Surface 713 formed in corner portion 718 of base 704 and the tamper-evident hinge can be on the same lateral side of base 704.

Those skilled in the art will readily appreciate that containers 100, 200, 300, 400, 500, 600 and 700 can be made from a variety of suitable materials such as, resins or plastic materials such as polyethylene, polypropylene, polyvinyl chloride or polyethylene terephthalate ("PETE"), as well as other suitable materials or combinations thereof, metallic materials, and/or paper materials. These materials can be transparent, translucent or opaque. It is also contemplated that the containers can be made in a variety of colors.

The methods and systems of the present disclosure, as described above and shown in the drawings, provide for containers with superior properties including child-resistance. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A child-resistant container comprising:

a lid having a peripheral flange which defines a lifting tab having top and bottom surfaces, wherein the lid includes a protrusion extending downwardly from the bottom surface of the lifting tab; and a base including:

an upper peripheral rim; and a surface formed in a corner portion of the base between two adjacent sides of the base, wherein the surface includes an aperture to receive the downwardly extending protrusion of the lid when the container is closed forming a child-resistant opening mechanism, and wherein the surface is uninterrupted but for the aperture;

wherein the lifting tab, the protrusion, the lid and the base have three relative positions to require a two-step, child-resistant opening, wherein:

in a first position the container is completely closed, and the upper peripheral rim hinders access to the lifting tab; and in a second position the protrusion is at least partially pushed out of the aperture of the base, exposing the lifting tab so the container can be manipulated to a third open position where the lid is released from the base.

2. The child-resistant container as recited in claim 1, wherein the protrusion defines a longitudinal axis and includes a plurality of pairs of tapered surfaces, wherein each pair of tapered surfaces includes a first tapered surface diverging radially outward from the longitudinal axis toward a second tapered surface, wherein the second tapered surface converges radially inward from the first tapered surface toward the longitudinal axis.

3. The child-resistant container as recited in claim 2, wherein the pairs of tapered surfaces are circumferentially spaced apart from adjacent pairs of tapered surfaces by longitudinally extending indented surfaces in the protrusion.

4. The child-resistant container as recited in claim 3, wherein the longitudinally extending indented surfaces are indented radially inward toward the longitudinal axis with respect to the pairs of tapered surfaces.

5. The child-resistant container as recited in claim 2, wherein each pair of tapered surfaces defines an apex between the first and second tapered surfaces.

6. The child-resistant container as recited in claim 1, wherein the lifting tab includes a hinge extending between adjacent sides of the lid.

7. The child-resistant container as recited in claim 6, wherein the hinge is raised with respect to the top surface of the lifting tab.

8. The child-resistant container as recited in claim 1, wherein the lifting tab includes ribs extending upwardly from the top surface of the lifting tab.

9. The child-resistant container as recited in claim 1, further comprising a tamper-evident hinge joining the lid with the base, the tamper-evident hinge including a frangible section.

10. The child-resistant container as recited in claim 9, wherein the frangible section includes at least one line of weakness.

11. The child-resistant container as recited in claim 9, wherein the frangible section includes a single score line.

12. The child-resistant container as recited in claim 9, wherein the frangible section includes two parallel score lines defining a tear strip therebetween.

13. The child-resistant container as recited in claim 9, wherein the surface formed in a corner portion of the base and the tamper-evident hinge are on the same lateral side of the base.

14. The child-resistant container as recited in claim 1, wherein the upper peripheral rim includes a bead extending upwardly from the upper peripheral rim which extends substantially about the perimeter of the container.

15. The child-resistant container as recited in claim 14, wherein a skirt extends downwardly from the bead.

16. The child-resistant container as recited in claim 1, wherein the base includes a retaining projection overlapping an outer edge of the lifting tab in the first position to keep the lifting tab seated when in the first position.

17. The child-resistant container as recited in claim 16, wherein the base includes a recess, and wherein the retaining projection extends into the recess to keep the lifting tab seated in the recess in the first position.

18. The child-resistant container as recited in claim 17, wherein the retaining projection includes a beveled surface facing in at least one of a direction toward the recess or a direction away from the recess.

19. A child-resistant container comprising:

a lid having a peripheral flange which defines a lifting tab having top and bottom surfaces, wherein the lid includes a protrusion extending downwardly from the bottom surface of the lifting tab; and a base including:

an upper peripheral rim; and a surface formed in a portion of the base, wherein the surface includes an aperture to receive the downwardly extending protrusion of the lid when the container is closed forming a child-resistant opening mechanism;

wherein the lifting tab, the protrusion, the lid and the base have three relative positions to require a two-step, child resistant opening, wherein:

in a first position the container is completely closed, and the upper peripheral rim hinders access to the lifting tab; and in a second position the protrusion is at least partially pushed out of the aperture of the base, exposing the lifting tab so the container can be manipulated to a third open position where the lid is released from the base.

20. The child-resistant container as recited in claim 19, wherein the surface is formed in a corner portion of the base between two adjacent sides of the base.

* * * * *